US006276406B1

(12) United States Patent
Mathieu

(10) Patent No.: US 6,276,406 B1
(45) Date of Patent: Aug. 21, 2001

(54) DRAINAGE RECEPTACLE

(76) Inventor: Christian Mathieu, 1288 rue Camille Frigon, Normandin Québec (CA), G8M 4A2

( * ) Notice: Subject to any disclaimer, the term of this patent is extended or adjusted under 35 U.S.C. 154(b) by 0 days.

(21) Appl. No.: 09/751,699

(22) Filed: Dec. 29, 2000

Related U.S. Application Data

(60) Provisional application No. 60/174,167, filed on Jan. 3, 2000.

(51) Int. Cl.[7] ..... B65B 1/04; B65B 3/04; B67C 3/02

(52) U.S. Cl. ..... 141/86; 141/87; 141/114; 141/1; 134/104.2; 184/106; 137/312

(58) Field of Search ..... 141/1, 85, 86, 141/87, 114; 134/104.2; 184/106; 137/312

(56) References Cited

U.S. PATENT DOCUMENTS

| | | | | |
|---|---|---|---|---|
| 5,423,339 | | 6/1995 | Latimer | 134/104.2 |
| 5,462,655 | | 10/1995 | Ladd et al. | 210/167 |
| 5,511,683 | | 4/1996 | Dailey | 220/573 |
| 5,597,001 | | 1/1997 | Rasmussen et al. | 134/104.2 |
| 5,642,834 | | 7/1997 | Shaw et al. | 220/720 |
| 5,669,982 | | 9/1997 | Latimer | 134/10 |
| 5,730,164 | * | 3/1998 | Midkiff et al. | 134/104.2 |
| 5,738,139 | * | 4/1998 | DeChard | 137/312 |
| 5,816,743 | | 10/1998 | Schmitz, Jr. | 405/53 |
| 5,846,021 | | 12/1998 | Bailey et al. | 404/28 |
| 5,916,658 | | 8/1999 | Mohr | 428/81 |
| 5,924,461 | | 7/1999 | Shaw et al. | 141/86 |
| 6,019,243 | | 2/2000 | Marino | 220/573 |

* cited by examiner

*Primary Examiner*—Timothy L. Maust
(74) *Attorney, Agent, or Firm*—Darby & Darby

(57) ABSTRACT

A drainage receptacle for collecting used water during washing of a vehicle having at least one pair of side wheels. The drainage receptacle including three individual rectangular elongated ground strips for installation on the ground and two individual rectangular elongated cover strips for installation over each pair of side wheels thereby allowing water to drain over the cover strips and directly onto the ground strips. Each ground strip having a bottom sheet and four sidewalls for retaining used water therein. Each cover strip being formed of a bottom sheet. The ground strips and cover strips are made of an impermeable material, such as vinyl.

11 Claims, 4 Drawing Sheets

DRAINAGE RECEPTACLE

"This patent application claims the priority of U.S. provisional patent application Ser. No. 60/174,167, Jan. 3, 2000, which is incorporated herein by reference."

FIELD OF THE INVENTION

The present invention is concerned with a receptacle for use for heavy duty equipment washing.

BACKGROUND OF THE INVENTION

Commercial car and truck washing has become a focus of public concern and government regulation recently over the disposal of used wash water into municipal sewer systems or directly into the ground. The combination of oil, water, soap, dirt and other chemicals in the used wash water can be harmful to the environment if allowed to drain into a sewer or seep into the earth.

It is now known to have mobile washers for washing cars, trucks and any other type of machinery on site. These washers are equipped with water treatment systems and are well described in U.S. Pat. No. 5,669.982. Typically the trucks are self-sufficient in that they contain all the equipment needed for the cleaning purposes, for instance, water reservoir, soap injector, sprayers, hoses, a nacelle or carriage and a drainage receptacle. During the washing, the used water is drained onto the drainage receptacle and forwarded back inside the washer in order to be recycled.

U.S. Pat. No. 5,423,339 is concerned with an apparatus for treating articles with wash water. This patent discloses the use of a wash pad comprising three unconnected portions. However, this patent does not disclose the use of longitudinal cover strips for fitting over the wheels of a vehicle, so as to further guide the water collected on the wheels of the vehicle onto the wash pads on the ground. The wash pads that are described in this patent only include a centre portion and side portions. No pads are provided for covering the wheels of the vehicle. Hence, the water that is collected on the wheels will directly seep in the ground.

SUMMARY OF THE INVENTION

It is an object of the present invention to provide a drainage receptacle that is designed to maximize the recycling of the water used for washing the vehicle.

It is also an object of the present invention to provide a drainage receptacle for use in the washing of heavy-duty vehicles.

It is another object of the present invention to provide a drainage receptacle that is designed to reduce the risk of tear by heavy-duty vehicles during installation of same.

More precisely, the present invention is concerned with a drainage receptacle for collecting used water during washing of a vehicle, the vehicle having at least one pair of side wheels, the drainage receptacle comprising:

individual substantially rectangular elongated ground strips for installation in parallel and spaced apart to each other on the ground so to form there between a passage for each pair of side wheels of the vehicle, each ground strip being made of an impermeable material and having a bottom sheet and four side walls for retaining used water therein, and individual substantially rectangular elongated cover strips for installation over each pair of side wheels respectively thereby allowing water to drain over the cover strips and onto the ground strips.

The present invention is also concerned with a drainage receptacle kit and a method for using the drainage receptacle of the present invention.

An advantage of the drainage receptacle of the present invention, is that it is now possible to execute on-site washing of heavy-duty truck such as a tractor, tracked vehicles, forest machinery and the like without running the risk of tearing the receptacle.

The drainage receptacle of the present invention also maximizes the recycling of the waste water resulting from the washing of the equipment.

The present invention and its advantages will be more easily understood after reading the following non-restrictive description of preferred embodiments thereof, made with reference to the hereinabove drawings.

DETAILED DESCRIPTION OF THE INVENTION

The drainage receptacle of the present invention comprises at least two individual strips that are elongated and substantially rectangular in shape. The strips are made of a suitable material that allows collecting the used water for recycling purposes. Each of these strips has four side edges 5, that is two side edges extending along a longitudinal axis and two opposite side edges defining the width.

Figure 1:
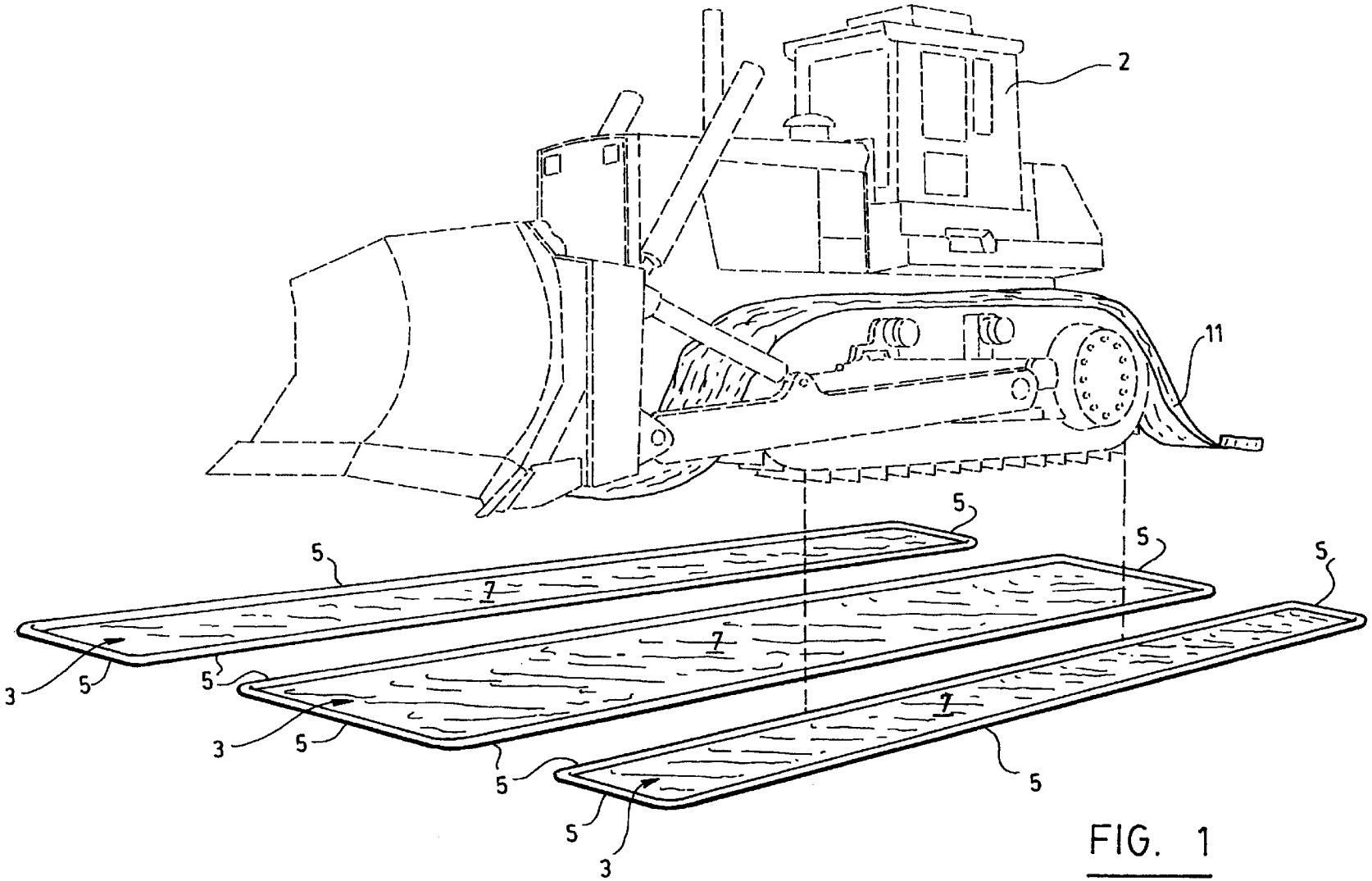
FIG. 1 is a perspective view of the drainage receptacle according to a preferred embodiment of the present invention.

As can be seen in FIG. 1, the drainage receptacle 1 according to the present invention comprises three individual substantially rectangular elongated ground strips 3 for installation in parallel. The ground strips 3 are spaced apart on the ground, so to form therebetween a passage 13 for each pair of side wheels of the vehicle 2. Each ground strip has a bottom sheet 7 and four sidewalls 5 for retaining used water therein. Each cover strip 11 has two opposite ends, each of which comprises a sidewall 13 for preventing the used water to seep on the ground. The ground strips and cover strips are made of an impermeable material.

The drainage receptacle 17 according to the illustrated embodiment further comprises two individual substantially rectangular elongated cover strips 11. The cover strips 11 are being adapted for installation over each pair of side wheels respectively there by allowing water to drain over the cover strips 11 and directly on to the ground strips 3.

Preferably, the ground strips 3 and the cover strips 11 are made of a resilient and flexible material, which may be vinyl.

Figure 2:
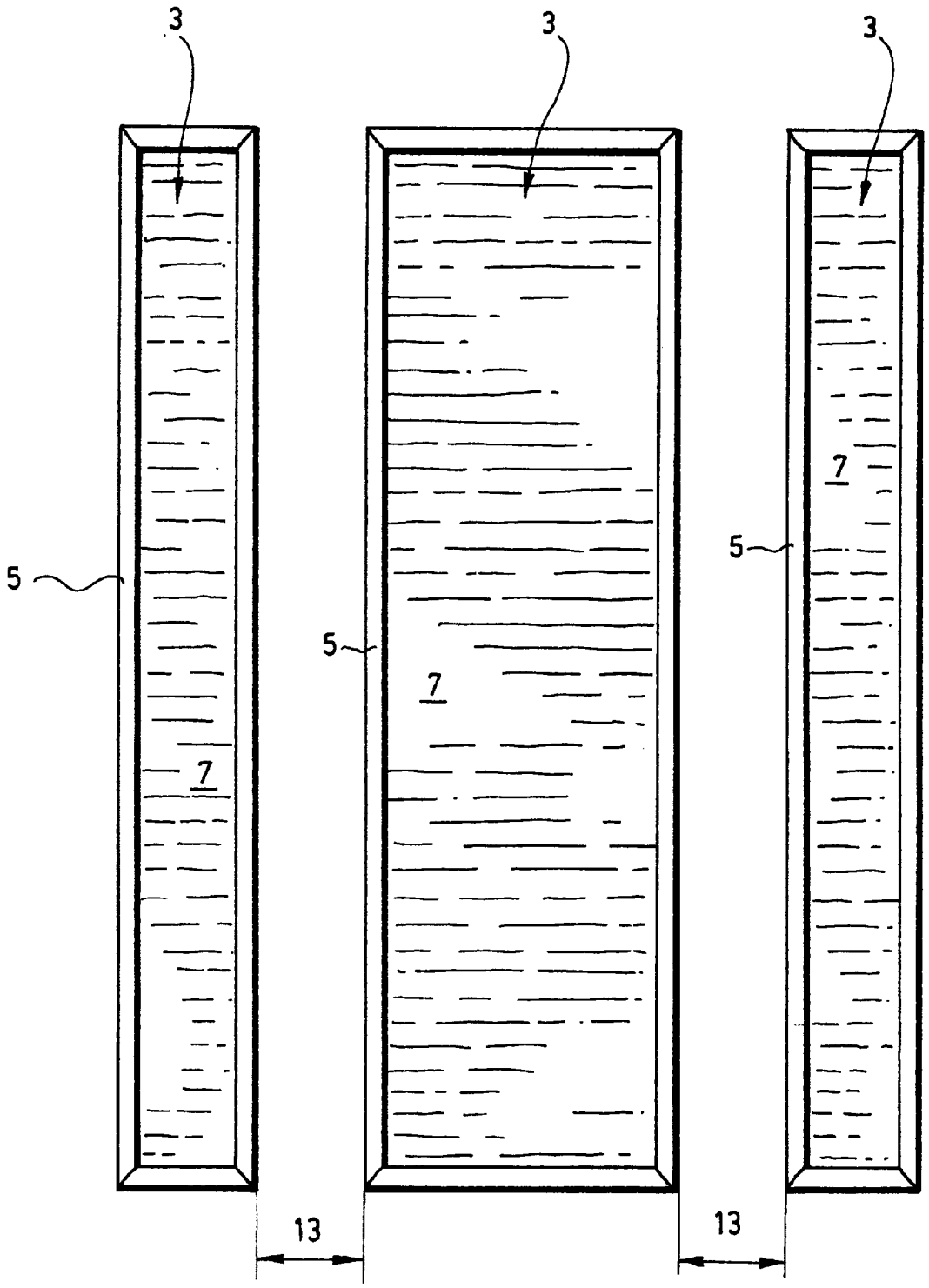
FIG. 2 is a top view of the ground strips of the drainage receptacle of FIG. 1.
Figure 3:
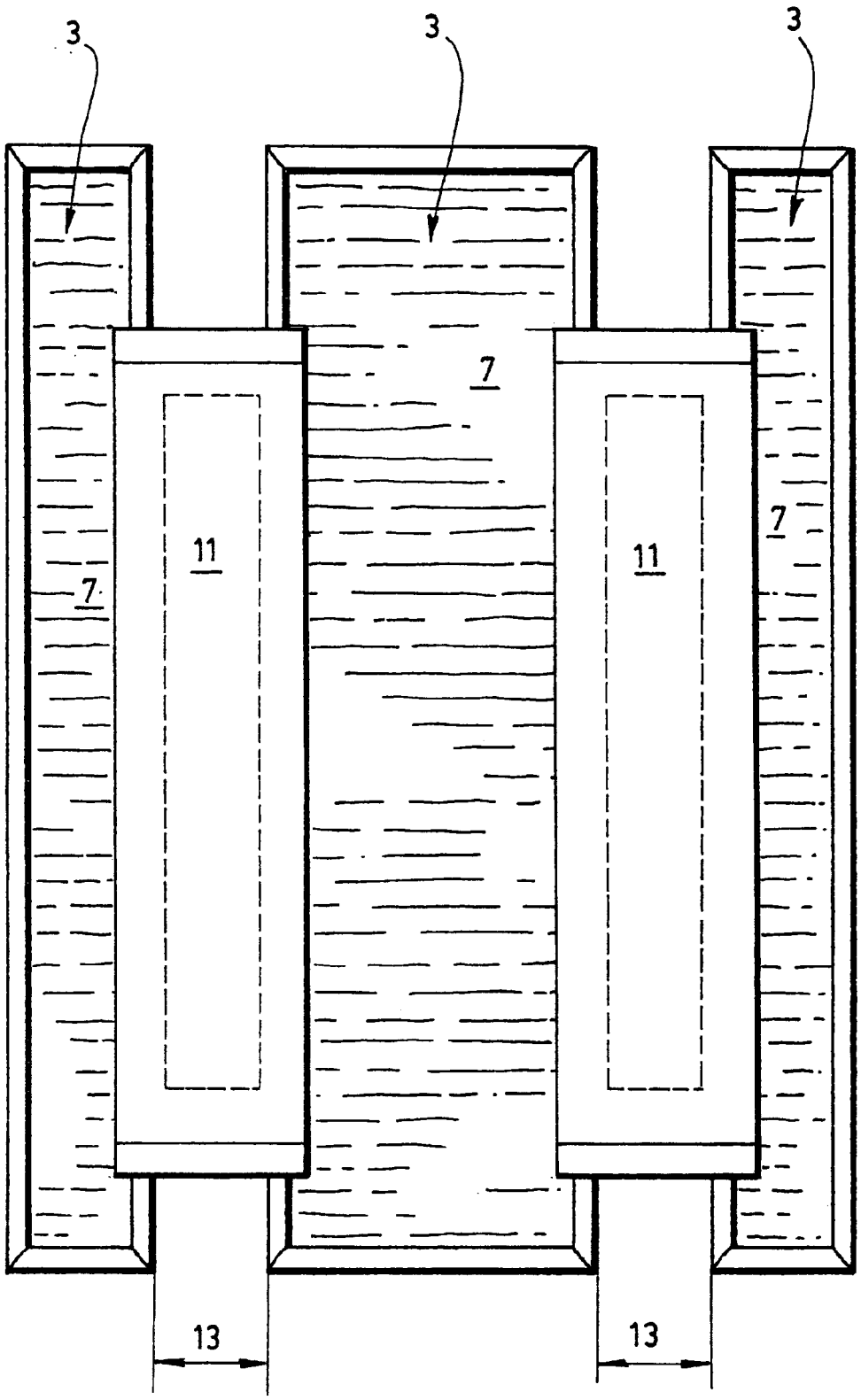
FIG. 3 is a top view of the drainage receptacle of FIG. 1.

FIGS. 2 and 3 are top views of the drainage receptacle according to the present invention.

Figure 4:
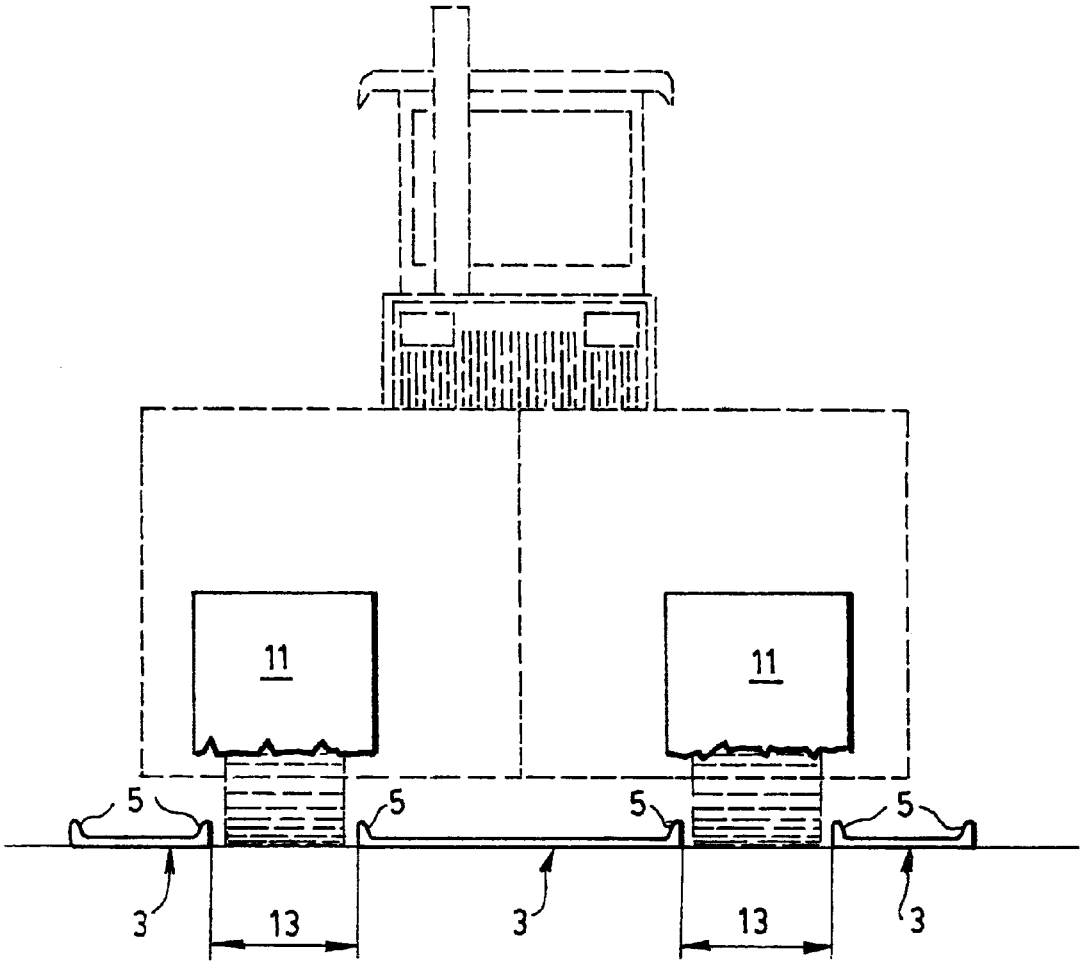
FIG. 4 is a front view of the drainage receptacle of FIG. 1.

As best seen in FIG. 4, the sidewalls 5 may be integrally formed with the bottom sheet 7. The sidewalls 5 and the bottom sheet 7 provide a trough-like configuration to define a containment area.

The present invention is also concerned with a drainage receptacle kit, which may be formed of at least two individual strips that are elongated and substantially rectangular. According to the present invention, the drainage receptacle kit comprises three individual rectangular elongated ground strips for installation and parallel and spaced apart to each other on the ground, so to form therebetween a passage for receiving a wheel of a vehicle, and two individual rectangular elongated cover strips for installation over the wheels of the vehicle thereby allowing water to drain over the cover strips and on to the ground strips The drainage receptacle kit of the present invention is formed of ground strips and cover strips shown in anyone of FIGS. 1 to 4.

In use, the strips are spaced apart and placed parallel to each other along a longitudinal axis. Three ground strips 3 are placed so to form a passage 13 for receiving the side wheels of the vehicle 2. The vehicle 2 is then moved in position between the ground strips 3 and the cover strips 11 are placed over the side wheels in such a way to allow the water to leak from the cover strips 11 to the ground strips 3 placed on each side of each side wheels.

In an alternative embodiment, the strips are spaced apart and placed parallel to each other along the longitudinal axis of the receptacle. The middle ground strip 3 is not laid flat on the ground before the vehicle 2 is installed above the drainage receptacle 1. The two side edges of the middle ground strip 3 are rolled up. Once the vehicle 2 is in place, that is the wheels between the ground strip 3, the side edges are flapped down. This creates a containment area to better hold the used water that will be eventually forwarded in the water treatment unit.

As mentioned above, the strips are placed in such a way to create spacing between each receptacle portions. Indeed, the spacing must allow the wheels of the vehicle to roll between the receptacle portions so that it does not come in direct contact with same and thereby significantly reducing the risk of tear by the wheels of the vehicle.

Although the present invention has been explained hereinabove by way of a preferred embodiment thereof, it should be pointed out that any modifications to this preferred embodiment within the scope of the present invention is not deemed to alter or change the nature and the scope of the present invention.

What is claimed is:

1. A drainage receptacle for collecting used water during washing of a vehicle, the vehicle having at least one pair of side wheels, the drainage receptacle comprising:

individual substantially rectangular elongated ground strips for installation in parallel and spaced apart to each other on the ground so to form there between a passage for each pair of side wheels of the vehicle, each ground strip being made of an impermeable material and having a bottom sheet and four side walls for retaining used water therein, and individual substantially rectangular elongated cover strips for installation over each pair of side wheels respectively thereby allowing water to drain over the cover strips and onto the ground strips.

2. A drainage receptacle according to claim 1, comprising three ground strips and two cover strips.

3. A drainage receptacle according to claim 1, wherein the sidewalls are integrally formed with the bottom sheet.

4. A drainage receptacle according to claim 1, wherein it is made of a resilient and flexible material.

5. A drainage receptacle according to claim 4, wherein the material is vinyl.

6. A kit according to claim 1, comprising three ground strips and two cover strips.

7. A method for installing a drainage receptacle according to claim 1, the method comprising the steps of:

a) placing at least two ground strips parallel to each other and spaced apart so to form a passage for receiving the side wheels of the vehicle, b) moving the vehicle in position between the at least two ground strips, and c) placing cover strips on each of the side wheels in such a way to allow the water to leak from the cover strip to the ground strips placed on each side of each side wheel.

8. A drainage receptacle kit for collecting used water during washing of a vehicle, the vehicle having at least one pair of side wheels, the drainage receptacle kit comprising:

individual substantially rectangular elongated ground strips for installation in parallel and spaced apart to each other on the ground so to form there between a passage for each pair of side wheels of the vehicle, each ground strip being made of an impermeable material and having a bottom sheet and four side walls for retaining used water therein, and individual substantially rectangular elongated cover strips for installation over each pair of side wheels respectively thereby allowing water to drain over the cover strips and onto the ground strips.

9. A kit according to claim 8, wherein the sidewalls are integrally formed with the bottom sheet.

10. A kit according to claim 8, wherein the ground strips and the cover strips are made of a resilient and flexible material.

11. A kit according to claim 9, wherein the material is vinyl.

* * * * *